United States Patent [19]

Rothenberger

[11] 4,034,591

[45] July 12, 1977

[54] DEVICE FOR ENLARGING PIPE ENDS

[75] Inventor: Günter Rothenberger, Bad Homburg, Germany

[73] Assignees: Rothenberger GmbH KG; Werkzeuge-Maschinen KG, both of Frankfurt am Main, Germany

[21] Appl. No.: 657,658

[22] Filed: Feb. 12, 1976

[30] Foreign Application Priority Data

Feb. 13, 1975 Germany ..... 2505915

[51] Int. Cl.[2] ..... B21D 41/02

[52] U.S. Cl. ..... 72/393

[58] Field of Search ..... 72/355, 393, 477; 279/1 A

[56] References Cited

U.S. PATENT DOCUMENTS

| | | | |
|---|---|---|---|
| 1,124,568 | 1/1915 | Wiedeke | 72/393 |
| 2,449,284 | 9/1948 | Dorman | 279/1 A |
| 2,684,103 | 7/1954 | Lee et al. | 72/355 |
| 2,828,538 | 4/1958 | Darden | 72/393 X |
| 2,999,529 | 9/1961 | Rast | 72/393 |
| 3,172,675 | 3/1965 | Gonzalez | 279/1 A |
| 3,906,775 | 9/1975 | Benimetzki | 279/76 |

*Primary Examiner*—Travis S. McGehee
*Assistant Examiner*—J. Sipos
*Attorney, Agent, or Firm*—Burgess, Dinklage & Sprung

[57] ABSTRACT

A tool for enlarging pipe ends includes a toolholder body containing an axially movable mandrel having a tapering end and capable of being displaced by an externally applied force. A toolhead is exchangeably attached to the toolholder body coaxially with the mandrel and contains a plurality of expanding members in the form of cylindrical segments radially displaceable by the axial displacement of the mandrel and mounted so that they project axially from the toolhead. The edges of the segments facing the mandrel form a recess corresponding to the mandrel taper. An adapter is interposed between the toolholder body and the toolhead and has a body containing an axially displaceable supplementary mandrel having an elongated tapering end for cooperating with the exchangeable toolhead. The other end of the supplementary mandrel contains a recess shaped to receive the tapering end of the mandrel mounted in the toolholder body.

11 Claims, 11 Drawing Figures

FIG. 5a
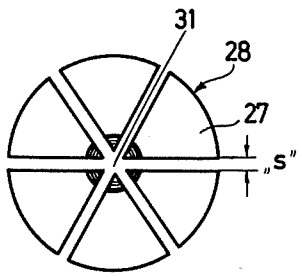
FIG. 5b
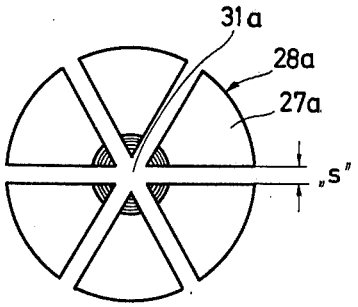
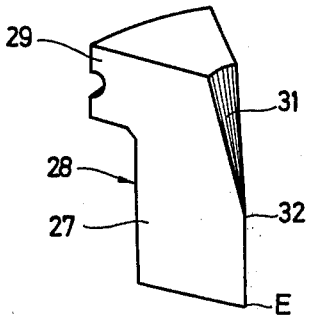
FIG. 6
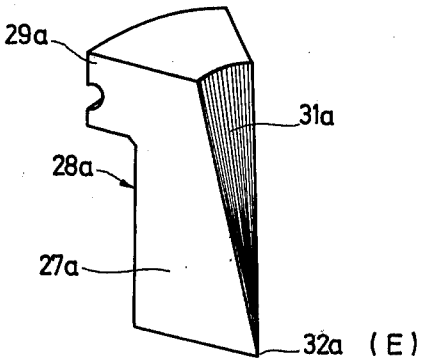
FIG. 7

FIG. 8
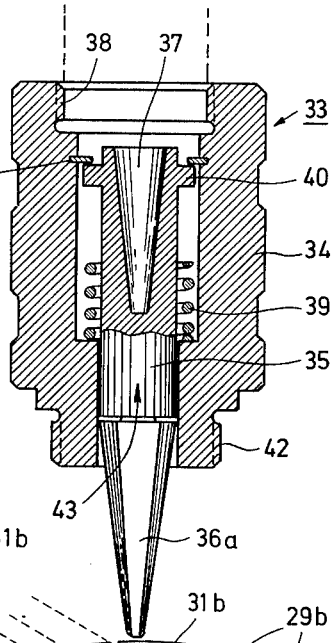
FIG. 9a
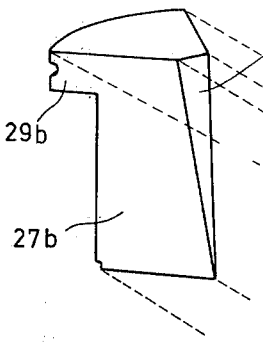
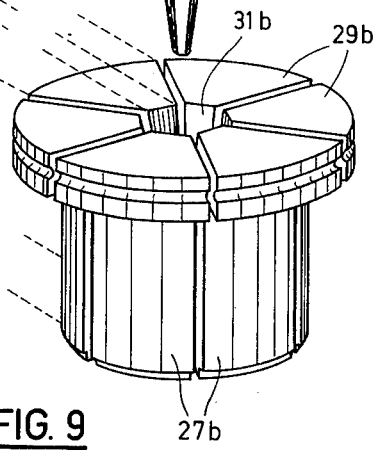
FIG. 9

DEVICE FOR ENLARGING PIPE ENDS

BACKGROUND

This invention relates to a tool for enlarging the ends of pipes which includes a toolholder body containing an axially movable mandrel having a tapering end and capable of being displaced by an externally applied force, and a toolhead exchangeably attached to the toolholder body co-axially with the mandrel and containing a plurality of expanding members in the form of cylinder segments radially displaceable by axial displacement of the mandrel and so mounted that they project axially from the toolhead, the segment edges facing the mandrel forming a recess corresponding to the mandrel taper.

Tools of this type are known (Published German Application No. 1,752,461). In this tool, the axial displacement of the mandrel inside the toolholder body is effected by a cam which cooperates with the rear face of the mandrel at the opposite end to that forming the elongated tapering end. The cam is operable by a lever arm carrying a handle or grip. A second arm carrying a handle is fixed to the body of the tool. This arrangement functions like a pair of caliper tongs from which the tapering end of the mandrel laterally projects. A toolhead containing the above defined expanding segments can be exchangeably screwed to the toolholder body. When the two arms are manually pressed together, they cause the mandrel to be displaced into the tapering recess in the center of the annulus of expanding segments which are thereby expanded and radially forced apart.. A pipe end fitted over the expanding segments will thus be enlarged sufficiently for it to receive the spigot end of another pipe. It will be apparent that, depending upon the material of which the pipes are made, considerable expanding forces must be generated.

Exchangeability of the toolhead is necessary to permit toolheads wherein the overall diameter of the annulus of expanding segments differs to be attached to the same toolholder body. However, the annulus of expanding segments must have a minimum overall diameter dictated by the major diameter of the mandrel. Otherwise the expanding segments would be too slim and lack the necessary mechanical strength to withstand the very high bending moments involved. It is therefore desired to keep the major diameter of the mandrel for a given angle of taper as small as possible in order to preserve the necessary mechanical strength. This has the undesirable result of impairing the functional reliability of the tool and of reducing the life of the expanding segments which is inherent in the manner in which the expanding segments are produced to endow them with the property of expandability.

The expanding segments are made from a solid cylindrical blank which is provided with an axial conical recess corresponding to the conically tapering end of the mandrel. An annular flange at one end of the cylinder serves for subsequently retaining the segments in the toolhead. However, for purposes of the present explanation this flange need not be taken into account. The cylinder containing the coned recess is then cut into say six equal segments. This is done with a sawblade which produces a specially wide cut because the material which the sawblade removes is intended to create the necessary gap that will enable the annulus of segments to be pushed radially closer together. In this contracted state the segments can then be inserted into the unexpanded end of a pipe for the purpose of being forced apart by the mandrel with the simultaneous enlargement of the pipe end. The segments are thus expanded until they attain the relative positions they originally occupied in the solid cylindrical blank from which they were cut. Fine castings produced to comply with these geometrical conditions that have been described would, of course, be equivalent.

However, the removal of material during the sawcut results in a significant reduction of the narrow surface areas that make contact with the mandrel. The sawcut moves the end of the conical recess from the bottom of the segments further up into the interior of the annulus of segments, and the mandrel which is forced into the interior of this annulus will not therefore make contact with a surface that extends from the top to the bottom end of each segment. This means that the specific contact pressure will be much higher, with a concomitant higher rate of wear and a tendency of the segments to tilt or of laterally slipping off the mandrel surface. Besides, a corresponding bending moment involving the unsupported projecting ends of the segments which are not backed by the tapering end of the mandrel will arise. While this may be acceptable when the expanding segments are fairly small, the problems become more significant as the diameter and length of the segments increase, assuming these segments are designed to cooperate with the same (small) mandrel. The expanding segments must necessarily define a greater diameter if they are to be used for wider gauge pipes wich usually also have a thicker wall, so that the magnitude of the radial expansion of the segments must also be correspondingly greater. This increased distance of radial separation necessitates the removal of more material during the subdivision of the cylindrical blank into the several segments and consequently the remaining surface available for contact with the tapering end of the mandrel will become unacceptably small.

The problem might be solved by using a toolholder body containing a larger mandrel, but this would preclude attaching the tool to a toolhead containing smaller expanding segments. For the great diversity of possible application, i.e., for pipes of a wide range of diameters, several expanding tools would therefore have to be kept available and the advantage afforded by the exchangeability of the toolhead containing the expanding segments would partly be lost.

SUMMARY

The present invention improves a tool of the type described above in such a way that the range of applicability of the tool with regard to the attachability thereto of small and large toolheads is enlarged.

According to the invention this is achieved by the provision of an adapter which can be interposed between the toolholder body and the toolhead, and which consists of a body containing an axially displaceable supplementary mandrel having an elongated tapering end for cooperation with the exchangeable toolhead, whereas its other end contains a recess shaped to receive the tapering end of the mandrel mounted in the toolholder body.

DESCRIPTION OF THE DRAWING

Embodiments of the invention and the manner in which the tool functions as well as the state of the art will now be more particularly described with reference to FIGS. 1 to 9 of the accompanying drawings in which:

FIG. 6 is a perspective view of an expanding jaw for a mandrel which in principle would be relatively too small, FIG. 7 is a perspective view of an expanding segment for a mandrel of appropriate size, FIG. 8 is a modification of the adapter according to FIG. 3, fitted with a pyramidal mandrel, FIG. 9 is a perspective view of an annulus of expanding segments appropriate for use with the adapter in FIG. 8, and FIG. 9*a* is a single expanding segment of the annulus in FIG. 9.

DESCRIPTION

Figure 1:
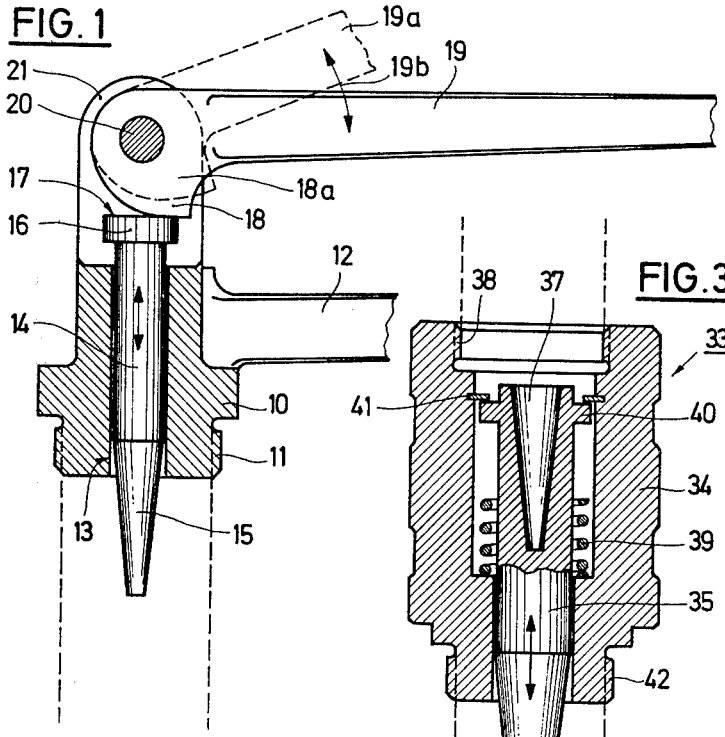
FIG. 1 is an axial section of the toolholder without the toolhead.

The adapter greatly widens the utility range of the tool by permitting a large number of different toolheads having expanding segments of different sizes to be attached to the toolholder body. The utility range can be widened in different respects. In the first place the mandrel and the supplementary mandrel may both have tapering ends having the same angle of taper. The built-in mechanical advantage of the tool is not thereby altered, i.e. the ratio of mandrel displacement to radial width of expansion remains the same. Alternatively the conically tapering end of the adapter mandrel may be provided with a different angle of taper, for instance with a smaller angle of taper, than that of the mandrel in the toolholder body. This improves the mechanical advantage and permits the process of expansion to be accomplished with the expenditure of less effort. Such a step is particularly useful in a tool comprising a double lever mechanism as described above. The adapter mandrel may alternatively have a diameter which is less than, greater than, or equal to the diameter of the toolholder mandrel.

The proposed adapter permits the use of toolheads having larger expanding segments in conjunction with toolholders having a smaller primary mandrel, or conversely, for the purpose of adapting the diameter of the mandrel optionally to the size of the expanding segments that are to be used. In the first of the two above alternatives the adapter mandrel may with advantage have a larger diameter at the base than the primary mandrel of the tool. This permits the internal conod recess inside the annulus of expanding segments to be substantially larger, the contacting surfaces between mandrel and expanding segments to be increased and, primarily, the surface contacting the mandrel to extend down the full length of the segments. The increased area of contacting surface improves the conditions of friction which would reduce the thrust and the expanding force. Moreover, manufacturing tolerances when producing the expanding segments by dividing a solid cylindrical blank are more easily bridged. In the case of a very small mandrel even the lightest lateral malalignment of a dividing slot would enhance the tendency of the segments to slip laterally off the mandrel. The provision of favorable frictional conditions is particularly useful because the proposed tool is principally used on building sites where maintenance usually leaves much to be desired.

In another embodiment the adapter is provided with a restoring spring which operates to retract the adapter mandrel into the body of the adapter. Prior art tools lack such a restoring spring and the reconstruction of the expanding segments must often be assisted by tapping them with a hammer. The mandrel inside the expanding segments is often an impediment since it may be prevented from withdrawing by reason of its taper being within the limiting angle of friction. The presence of a restoring spring will ensure that the expanding segments will readily yield radially inwards. The proposed adapter will therefore also prove useful when the diameters of the primary mandrel and of the supplementary adapter mandrel are equal, in as much as the reactoring sring facilitates handling the tool.

In a preferred arrangement the restoring spring may be so contrived that it is effective only within the final part of the displacement of the adapter mandrel. The resistance of the restoring spring need not then be overcome during the first part of the displacement of the mandrel in expanding direction. The additional effort needed towards the end of the displacement of the mandrel is less objectionable. However, the presence of a restoring spring which takes effect during the last part of mandrel displacement assists engagement of the pawl in a double lever mechanism, as described in the prior art tool.

The adapter is by no means an expensive component. It is preferred that the adapter and its mandrel should substantially both be axially symmetrical, i.e. bodies of revolution, one end of the adapter body being threadedly attachable to the toolholder body and the other end to the toolhead. Screw type joints are not the only possible type of joint for this purpose. For example, push-and-turn types of joint would also be feasible.

Furthermore, with particular advantage the tapering end of the adapter mandrel need not be conical, instead of which it could have a polygonal pyramidal taper which would naturally be arranged to match the internal taper recess in the annulus of expanding segments, i.e. this internal taper would likewise define a hollow polygonal pyramid, the edges of the pyramid coinciding with the divisional gaps between neighboring segments. The contacting faces in this case would be completely flat and thus always ensure the creation of flush contact at the highly loaded sliding interfaces in any relative position of mandrel and segments. This reduces the specific surface pressure and improves lubrication. Moreover, the segments cannot slip off the mandrel faces in the sideways direction. Consequently, the effort needed for operating the tool will be less and the life of the tool will be longer.

Suitable polygonal pyramids can be four-sided hexagonal or octagonal and their angles at the vertex could be chosen from within a wide range of angles. As a recaution the top of such a pyramid will usually be cut off so that technically the pyramid will be truncated.

In order to permit the toolhead to be screwed to the adapter it may in such a case be desirable to interpose a rotary joint between the pyramidal tapering end of the mandrel and the mandrel body, but this is by no means essential since, generally speaking, the adapter mandrel will already be freely rotatably mounted in the adapter body.

By using an adapter which provides a "cone-to-pyramid" coupling it is possible to modify existing tools — i.e. toolholders — to operate toolheads designed for pyramidal mandrels in order to secure the above mentioned advantage.

Referring to FIG. 1 there is provided a substantially axially symetrical toolholder body 10 provided at its bottom and with screw threads 11. The toolholder body 10 is formed with a laterally projecting arm 12 provided at its end, not shown, with a handle or grip. The toolholder body 10 is provided with an axial bore 13 axially slidably containing a mandrel 14. The mandrel has an elongated conically tapering end 15 which projects from the toolholder body 10. The rear end of the mandrel 14 has a head 16 with a flat surface 17 for cooperation with the peripheral face of a cam 18 formed on a lever 19 which at its end is likewise fitted with a handle, not shown. The cam 18 and the lever 19 are mounted on a pivot pin 20 in lug-shaped bearing 21 at the upper end of the toolholder body 10. This lever 19 can be deflected for instance in the direction indicated by an arrow **19*b* into a position 19*a* in chain line contours, in which case the cam 18 will be turned into a position 18*a* likewise shown in a chain line contour. In this position the mandrel 14** can yield in the arrowed direction upwards.

Figure 2:
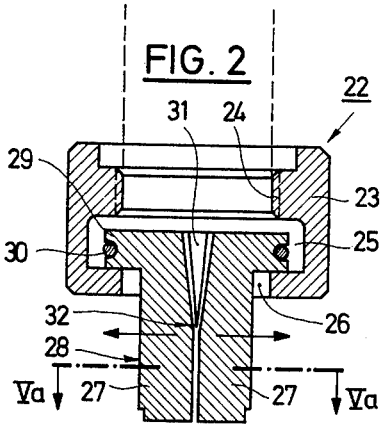
FIG. 2 is an axial section of a toolhead containing expanding segments, and designed to be screwed to the toolholder shown in FIG. 1.

A toolhead generally marked 22 in FIG. 2 is attachable to the toolholder body shown in FIG. 1. This toolhead comprises a sleeve 23 containing an internal screw thread 24 which fits the external screw thread 11. The lower part of the sleeve 23 contains an internal peripheral recess 25 and a control opening 26 for the reception of six expanding segments 27 of which the drawing shows only three. The expanding segments 27 have a part cylindrical peripheral surface 28, but in the illustrated position the peripheral surfaces of all the expanding segments do not in combination define a common cylindrical surface. This will be explained later with reference to FIG. 5. The ends of the expanding segments which are contained inside the sleeve 23 are each provided with a flanged edge 29 containing a groove and all the grooves together peripherally embrace the segments for the reception of a split spring ring 30. This spring ring pulls the expanding segments as closely as possible together, i.e. into the position illustrated in FIG. 2.

Figure 4:
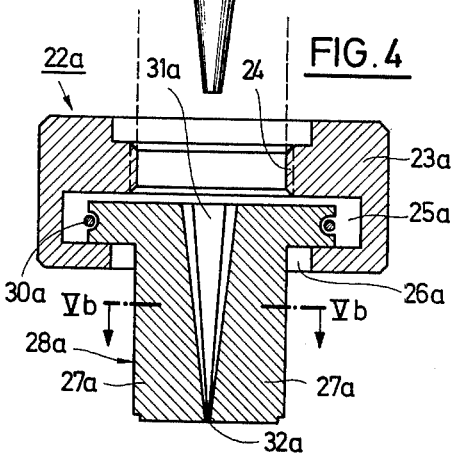
FIG. 4 is an axial section of a toolhead having larger expanding segmemts than those in FIG. 2, suitable for use in conjunction with the adapter mandrel in FIG. 3, FIG. 5*a* and 5*b* are cross sections taken on the lines V*a* — V*a* and V*b* — V*b* in FIGS. 2 and 4.

The expanding segments 27 substantially complete segments from which portions 31 are machined away on the inside. When the segments are forced apart these portions define a conical recess which matches the tapering end 15 of the mandrel 14. When the mandrel end 15 enters the conical recess 31 the expanding segments 27 will therefore be forced apart in the direction indicated by two horizontal arrows, causing a pipe end which may have been pushed over the contracted segments to be correspondingly enlarged. It will be understood that the conical recess 31 extends down only pat of the axial length of the expanding segments 27, namely from the top downwards to a point determined by the machining operation and based on the desired function of the segments as will be further explained in connection with FIGS. 5 and 7. In any event the continued descent of the end 15 of the mandrel 14 into the annulus of segments does not afford further support to the freely projecting ends of the expanding segments 27 which are therefore subjected to bending stress. The arrangement shown in FIG. 2 illustrates the smallest possible toolhead for a mandrel 14 of a kind shown in FIG. 1. It will be readily appreciated that the magnitude of the contacting surfaces in the recess 31 and the position of the apex at 32 would not change if the expanding segments were enlarged (in diameter amd length). However, the operating forces and hence the frictional and bending forces would increase cnsiderably. These circumstances will be readily apparent if it is imagined that a much larger toolhead such as that in FIG. 4 provided with an internal recess **31*a* equal in size to that in FIG. 2 were associated with a tool such as that illustrated in FIG. 1.**

Figure 3:
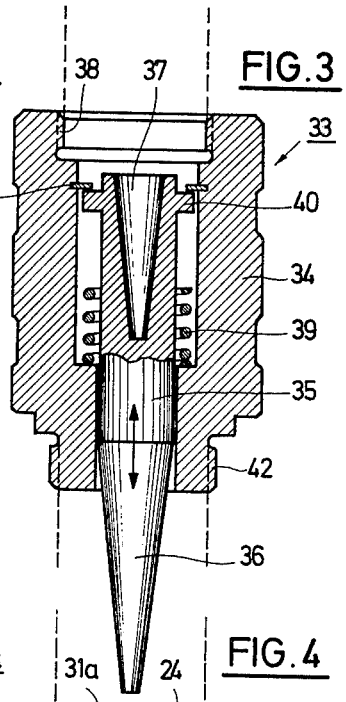
FIG. 3 is an axial section of an adapter fitted with a mandrel of greater diameter than that in FIG. 1.

FIG. 3 illustrates the adapter 33 the invention proposes to provide. This consists of an adapter body 34 containing an axially movable supplementary mandrel 35 of which the bottom end 36 has an elongated conical taper 36, whereas the other end contains a conical recess 37 suitable for the reception therein of the end 15 of mandrel 14 when the adapter body 33 is attached by means of its internal screw threads 38 to the toolholder body 10. The vertex angle of the conically tapering end 36 equals that of the conical end 15. However, the major diameter of the adapter mandrel 35 is greater by a factor of 1.5 than the major diameter of the mandrel 14. The adapter in FIG. 3 is therefore suitable for cooperation with a lager toolhead, such as that shown in FIG. 4. Interposed between the adapter body 34 and the adapter mandrel 35 is a restoring spring 39 which has a suitably steep spring rate, but which is so short that it takes effect only during the final part of the displacement of the adapter mandrel 35 by coming into contact with a collar 40 on the adapter mandrel. An additional much weaker spring, not shown in the drawing, may be provided to keep the adapter mandrel 35 in the illustrated position in which the collar 40 bears against a retaining ring 41 inside the adapter body 34. The conically tapering end 36 projects a corresponding distance from the body 34 of the adapter analogously to FIG. 1. In FIG. 4 parts corresponding to parts in FIG. 2 are identified by the same reference numbers, amplified by an index *a* where these parts have substantially larger dimensions. It will be understood that the internal conical surface **31*a* of the recess extends down the entire length of the expanding segments 27*a* to a point 32*a*, i.e. much further down than in FIG. 2 where the segments are intended for cooperation with the shorter tapering end 15 of mandrel 14. This arrangement provides the above discussed advantages. By means of its threads 24 the larger toolhead 22*a* is screwed to the threads 42 on the adapter 33 which is itself attached to the toolholder body 10 in FIG. 1 by engagement of the threads 38 with the threads 11 on the body 10.**

In FIG. **5*a*** which is a section taken on the line V*a* — V*a* in FIG. 2 the expanding segments 27 are shown in expanded position in which their part cylindrical peripheral surfaces form parts of a common cylinder surface. This cylinder surface corresponds to the cylinder surface of a round section blank from which the segments have been produced. The conical recess 31 is produced first. A gap of width *s* is then cut with a saw blade which makes a cut of appropriate width. This gap provides the space needed for later pushing the segments together. The effect of making such cuts of width *s* is shown in FIG. 6. The bottom end of the conical recess 31 which had originally reached the bottom end "E" of each segment is displaced upwards to point 32 which also the end of the surface which makes contact with the conical peripheral surface 15 of the mandrel 14. The portion from point 32 down to E will not therefore be in contact with the mandrel and will be subjected to a lever effect. It is apparent that the contacting surface of the recess 31 which is shaded is considerably reduced by the removal of material during the formation of the slot.

The expanding segment according to FIG. 7 is based on the production principle illustrated in FIG. 5*b*, in which the recess 31*a* corresponds to the much larger base diameter of the tapering end 36 of the adapter mandrel 35. Notwithstanding the removal of the material when the cylindrical blank was divided into several segments the bottom end of the shaded contacting surface of the recess 31*a* still extends to the bottom end E of the expanding segment. That advantage can be taken of this possibility is entirely due to the provision of the adapter 33. Tolerational variations have a correspondingly smaller effect.

In FIG. 8 parts corresponding to parts in FIG. 3 are again identified by the same reference numbers. The end 36*a* of the adapter mandrel 35 in this embodiment is, however, shaped like a hexagonal pyramid attached to the body of the adapter mandrel 35 by a rotary coupling. This coupling consists of a pivot pin, not indicated by a reference, projecting from the base of the pyramid into the body of the adapter mandrel in the direction of arrow 43. The pyramid is prevented from falling off by a spring ring not visible in the drawing. By making suitable allowances provision is made for slight lateral pendulum movements of the end 36*a* to enable minor axial misalignment to be absorbed.

FIG. 9 is an annulus of expanding segments 27*b* having flanged ends 29*b* and a recess 31*b* matching the geometry of the polygonal end 36*a* of the adapter mandrel, i.e. the triangular face of the recess on the internal edge of each segment, which is clearly visible in FIG. 9*a*, is flat — contrary to the corresponding surfaces in FIGS. 6 and 7.

I claim:

1. Tool for enlarging pipe ends comprising toolholder body means containing axially movable mandrel means having a tapering end and capable of being displaced by an externally applied force, toolhead means exchangeably attachable to the toolholder body means coaxially with the mandrel means and containing a plurality of expanding members in the form of cylinder segment means radially displaceable by the axial displacement of the mandrel means and mounted so that they project axially from the toolhead means, the edge of the segment means facing the mandrel means forming a recess corresponding to the mandrel means taper, adapter means interposed between the toolholder body means and the toolhead means, and having a body containing an axially displaceable supplementary mandrel means having an elongated tapering end for cooperation with the exchangeable toolhead means, the other end of the supplementary mandrel means containing a recess shaped to receive the tapering end of the mandrel means mounted in the toolholder body means said adapter means transferring the motion of the mandrel means of the toolholder body to the expanding members of the exchangeable toolhead means.

2. Tool of claim 1 wherein the conical ends of the mandrel means and the supplementary means have the same angle of taper.

3. Tool of claim 2 wherein the diameter of the supplementary mandrel means is greater than that of the mandrel means in the toolholder body means.

4. Tool of claim 2 wherein the supplementary mandrel means has the same diameter as the mandrel means in the toolholder body means.

5. Tool of claim 2 wherein the supplementary mandrel means has a smaller diameter than the mandrel means in the toolholder body means.

6. Tool of claim 1 wherein the tapering end of the supplementary mandrel means has a taper angle which differs from that of the tapering end of the mandrel means in the toolholder means.

7. Tool of claim 1 wherein the body of the adapter means contains restoring spring means which operates to draw the supplementary mandrel means back into the body of the adapter means.

8. Tool of claim 7 wherein the restoring spring means is so designed that it acts only during the final part of the displacement of the supplementary means for forcing apart the segment means.

9. Tool of claim 1 wherein the body of the adapter means and the supplementary mandrel means are substantially bodies of revolution and one end of the body of the adapter means is threadedly attachable to the toolholder body means and the other end to the toolhead means.

10. Tool of claim 1 wherein the supplementary mandrel means has a pyramidal tapering end.

11. Tool according to claim 10 wherein rotary coupling means is positioned between the pyramidal tapering end and the body of the supplementary mandrel.

* * * * *

UNITED STATES PATENT AND TRADEMARK OFFICE

CERTIFICATE OF CORRECTION

PATENT NO. : 4,034,591
DATED : July 12, 1977
INVENTOR(S) : Gunter Rothenberger

It is certified that error appears in the above-identified patent and that said Letters Patent are hereby corrected as shown below:

Column 4, line 63 - "recaution" should read --precaution--

Column 5, line 61 - after 'only' "pat" should read --part--

Column 6, line 28 - after 'with a' "lager" should read --larger--

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*